US005758868A

United States Patent [19]

Shea

[11] Patent Number: 5,758,868

[45] Date of Patent: Jun. 2, 1998

[54] SILT FENCE

[75] Inventor: Brian M. Shea, Cape Coral, Fla.

[73] Assignee: Siltco Industries Inc., Philadelphia, Pa.

[21] Appl. No.: 796,281

[22] Filed: Feb. 7, 1997

[51] Int. Cl.[6] ..... E01F 7/02

[52] U.S. Cl. ..... 256/12.5; 256/19; 256/45; 256/24; 405/21; 405/258

[58] Field of Search ..... 256/19, 12.5, 45, 256/24, 5, 47, 48, 25, 26; 160/392, 395, 135, 229.1; 405/21, 258

[56] References Cited

U.S. PATENT DOCUMENTS

| | | | |
|---|---|---|---|
| 1,246,544 | 11/1917 | Chassaing | 160/392 X |
| 3,875,623 | 4/1975 | Johnston | 160/392 X |
| 3,962,827 | 6/1976 | Chaffee | 160/135 X |
| 4,576,364 | 3/1986 | O'Fearna | 256/24 |
| 4,690,384 | 9/1987 | Palmer | 256/47 |
| 4,756,511 | 7/1988 | Wright, III | 256/52 X |
| 5,108,224 | 4/1992 | Cabaniss et al. | 256/12.5 |
| 5,291,708 | 3/1994 | Johnson | 256/24 X |

FOREIGN PATENT DOCUMENTS

3345324 A1 6/1985 Germany .

*Primary Examiner*—Kenneth J. Dorner
*Assistant Examiner*—William L. Miller
*Attorney, Agent, or Firm*—John Lezdey

[57] ABSTRACT

A silt fencing for use at a construction site to prevent soil erosion by wind and water forces and comprises in combination a flexible plastic fencing material, a plurality of post units comprising about three contiguous elongated hollow tubes, consisting of a central tube adapted to receive a retractable stabilizing component such as a steel rebar for insertion in the ground and two outer tubes each having a slit along their length to accommodate the rigid rods attached to the fencing material.

13 Claims, 1 Drawing Sheet

SILT FENCE

BACKGROUND OF THE INVENTION

1. Field of the Invention

The invention relates to fences and more particular, silt fences which prevent soil erosion and provide a long and maintenance-free service-life.

2. Description of the Prior Art

Silt fences are used primarily to prevent the erosion of soil (silt) and in some cases with the contamination of bodies of water with such run-off. Conventional silt fences are constructed of flexible plastic material attached to wooden stakes, which are driven into the ground. However, this construction is susceptible to adverse effects produced by the wind. The wind causes the fencing material to pull at the attachment and eventually it becomes torn and does not function for the purpose intended. This requires repair and constant monitoring, as well as, over time more maintenance as the deterioration accelerates.

Attempts have been made to use wire reinforced silt fences. These must be fabricated in the field but installation costs are doubled. Therefore, there exists a need to provide an economical fence, with low installation costs and which is virtually maintenance-free.

SUMMARY OF THE INVENTION

The present invention relates to an improvement in the manner of securing a flexible plastic fencing material to a fence post element which provides a silt fence which is more wind-resistant and maintenance-free. The fence comprises in combination, a plurality of post units, a flexible plastic fencing material having rigid rod means at two opposing ends wherein each of said post units consist of about three contiguous hollow elongated tubes, the central tube contains a retractable stabilizing means for ground insertion; and wherein the outer tubes have a slit along their length to accommodate said rod means of said fencing material.

The invention is directed to silt fences useful at construction sites, farms, excavations and mining areas. Broadly "silt fence" also includes fences used to prevent beach or sand dune erosion, snow fence and construction safety fencing.

A primary object of this invention is to provide a wind resistant flexible plastic fencing which is easily installed, and has fastener elements which secure a flexible plastic fencing material in position and substantially eliminates damage to the fencing material caused by wind effects.

Another object of the present invention is to provide a wind resistant flexible plastic fence which is simple to manufacture and easy to transport.

Another, more particular object of the present invention is to provide a silt fence which is wind resistant, economical to manufacture, easy to install and is substantially maintenance-free.

Yet another particular object of the present invention is to provide such wind resistant silt fencing which can be installed with the use of fewer tools than are required for conventional silt fences.

BRIEF DESCRIPTION OF THE DRAWINGS

Further advantages and a more complete understanding of the invention can be obtained by referring to the following detailed description of specific embodiments when taken in conjunction with the accompanying drawings in which.

DETAILED DESCRIPTION OF THE PREFERRED EMBODIMENTS

Figure 1:
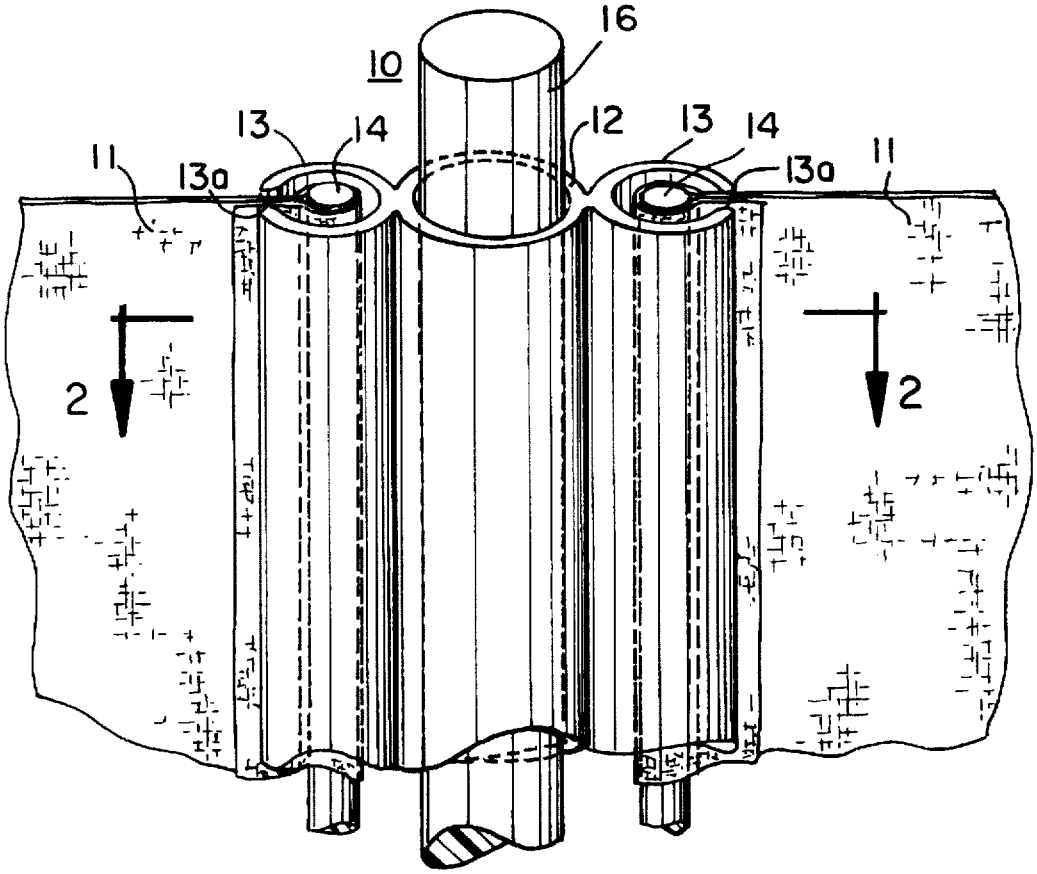
FIG. 1 is a perspective view of a preferred embodiment of the invention in which a post unit is shown between two flexible plastic fencing materials having rigid rod means at two opposing ends.
Figure 2:
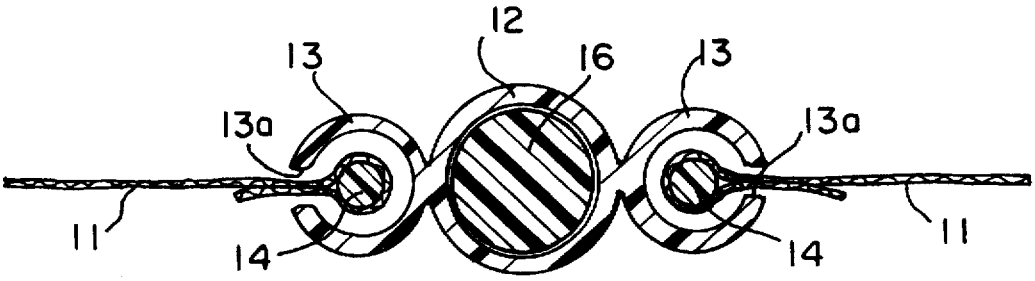
FIG. 2 shows a top view of the improved fence system of this invention.

Referring to the drawings wherein like reference numerals designate corresponding components throughout the several views, there is shown in FIG. 1 one form of the fence 10 of the present invention. The fence 10 comprises post units 15, a flexible plastic fencing material 11, rigid rod means 14 for attaching both fencing material segments 11 and the outer tubes 13 having slits 13*a* integral with central tube 12 in the manner shown.

In FIG. 1, each post unit 15 must be strong enough to support and hold the flexible plastic fencing material after the stabilizing means is inserted in central tube 12. The post unit 15 may be constructed from a solid piece by molding or extrusion. Preferably rigid polyvinyl chloride is the material of choice. Also from an economical and convenience standpoint, rigid polyvinyl chloride is preferred. Generally, post units which measure about 28×2⅜ inches are used for construction and excavation sites. As shown in FIG. 1, the central tube 12 is about one inch O.D. with the outer tubes about ¾ inch O.D. The preferred retractable stabilizing means is a ⅝ inch steel rebar 16.

The flexible plastic fencing material 11 is sufficiently flexible so that it can be bent along a line prior to an attachment operation and has a high tensile strength. In addition; the weave of the fabric or the perforations of the sheet should be sufficient to permit the passage of air to reduce the wind force on the fencing material 11. Further, these characteristics permit water to pass through while keeping the silt n place As indicated, the plastic fencing material which generally is of a height of about 3 to 6 feet may be either in woven or sheet form. Obviously the sheet must have perforations to be effective. Also a netting may be made from woven fibers, and it is useful for this purpose. Suitable flexible plastic materials include olefin polymers, such as high density polyethylene and high density polypropylene, nylon, fiberglass or vinyl resins. Most preferred is woven polypropylene fabric with ultraviolet inhibitors.

The retractable stabilizing means (not shown) may be made of metal, wood, plastics or composites thereof. The rigid rod 14 is placed in tubes 13 and the affixed fencing material 11 functions to disseminate the forces normal to the fencing material, i.e. to distribute either the wind forces or the force of flowing water or both. Thus, the fabric or sheet fencing material 11 does not tear, remains intact and in position on the post unit 15. The post unit may be made from plastics broadly classified as engineering plastics which are rigid, tough and not brittle with high tensile strength, good thermal stability, and good resistance to abrasion and weatherability. They are easily processed by extrusion or molding from olefin polymers such as high density polyethylene and polypropylene, polycarbonates, rigid vinyl resins such as polyvinyl chloride.

In an application of the present invention, silt fence is transported to a construction site and then assembled.

Assembly at the site is preferred, since components are easily transported and set-up with minimum skill However the single construction and the use of unskilled labor to assemble the fence, affords assembly at the construction site with a minimum of tools.

The primary interest is use as a silt fence which is to be inserted into the ground. With suitable modifications well within the skill of those familiar with the art, the fencing of this invention may be used as construction safety netting. This would be useful in the construction of multi-story buildings such as skyscrapers where it is necessary to install temporary vertical safety barriers at the edges of open floors to prevent construction materials such as tools, bricks, etc. from falling from the floors and endangering people and property below.

Accordingly, although the invention has been described in terms of particular embodiments and applications one of ordinary skill in the art, in the light of this teaching can generate additional embodiments and modifications without departing from the spirit of or exceeding the scope of the claimed invention. It is to be understood that the drawings and descriptions herein are preferred by way of example to facilitate comprehension of the invention and should not be construed to limit the scope thereof.

What is claimed is:

1. A fence comprising in combination:

a flexible fencing material;

a plurality of cost units; and a stabilizing means;

wherein said fencing material includes rigid rods at opposing ends whereby said fencing material encircles said rods; and said post units consists of at least three contiguous elongated hollow tubes including:

a central tube adapted to receive said stabilizing means; and a plurality of outer tubes each having a central opening; and a slit;

said rods and said outer tubes forming an attachment means for attaching said fencing material to said post units as said outer tubes are sized to accommodate and maintain said rods and said slits permitting extension of said flexible material attached to said rods through said outer tubes.

2. A fence of claim 1 wherein the contiguous tubes are integral or bonded.

3. The fence of claim 1 wherein said outer tubes are of smaller size than said central tube.

4. The fence of claim 1 wherein said stabilizing means is material selected from wood, metal, plastic or composites thereof.

5. The fence of claim 4 wherein said stabilizing means is a steel bar.

6. The fence of claim 1 wherein said rods are manufactured of material selected from wood, metal, plastic or composites thereof.

7.The fence of claim 6 wherein said material is wood.

8. The fence of claim 1 wherein said flexible fencing material is an elongated woven fabric or a perforated sheet.

9. The fence of claim 1 wherein said flexible fencing material is manufactured from plastic selected from high density olefin polymers, nylon, fiberglass or vinyl resins.

10. The fence of claim 9 wherein said olefin polymers are selected from polyethylene and polypropylene.

11. The fence of claim 10 wherein said polypropylene contains ultraviolet light inhibitors.

12. The fence of claim 1 wherein said rods are larger than said slits thereby allowing the mounting of mounting said rods in said tubes.

13. The fence of claim 1 wherein said outer tubes are located opposite said central tube.

* * * * *